United States Patent [19]

Checheljuk et al.

[11] 4,081,003

[45] Mar. 28, 1978

[54] MACHINE FOR WINDING CONTINUOUS ELECTRIC WINDINGS

[76] Inventors: Yakov Zinovievich Checheljuk, Dnepropetrovskoe shosse, 62/65; Gennady Ivanovich Pshenichny, ulitsa Kremlevskaya, 27/8; Nikolai Ivanovich Mykalo, ulitsa Relefnaya, 2/57, all of Zaporozhie, U.S.S.R.

[21] Appl. No.: 751,066

[22] Filed: Dec. 16, 1976

[51] Int. Cl.[2] ..... B21F 3/08

[52] U.S. Cl. ..... 140/92.2; 242/7.14

[58] Field of Search ..... 242/7.14; 72/144, 140; 140/92.2

[56] References Cited

U.S. PATENT DOCUMENTS

| | | | |
|---|---|---|---|
| 2,736,345 | 2/1956 | Caldwell | 140/92.2 |
| 3,106,504 | 10/1963 | Carter | 140/92.2 |
| 3,750,719 | 8/1973 | Goldman | 140/92.2 |

*Primary Examiner*—Edward J. McCarthy
*Attorney, Agent, or Firm*—Lackenbach, Lilling & Siegel

[57] ABSTRACT

The machine for winding continuous electric windings comprises a framework supporting thereon a carriage movable along the framework and having an annular housing. Mounted inside the housing is an annular rotatable base having mounted thereon members for placing the wire being wound. Mounted on the end portion of each wire-placing member is a driving roller movably engaging a friction templet mounted on the annular housing. The movement of the driving rollers along the friction templet provides for movement of respective the wire-placing members in the direction toward the coil section being wound. The opposite end portion of each of the wire-placing members supports an additional guiding member made in the form of a roller and designed for feeding the wire into the winding zone.

2 Claims, 3 Drawing Figures

MACHINE FOR WINDING CONTINUOUS ELECTRIC WINDINGS

The invention relates to production equipment employed for the manufacture of the windings of electric induction apparatus and, more particularly, it relates to machines for winding continuous electric windings and can be utilized for manufacture of electric apparatus for winding continuous electric windings, e.g. those incorporated in transformers and reactors.

There is known a structure which can be used for manufacturing high-power transformer windings of a wire with a relatively large cross-sectional area. In this case manufacture of windings is accomplished by means of an apparatus comprising a rotatable base and a plurality of wire-guiding or placing members cooperating with the wire being wound and made in the form of annular wood segments. In the process of the winding operation these annular segments occupy the place of the coils of the winding turns still to be wound.

However, the manufacture of windings by the above-described technique is labor-consuming, because it requires a considerable amount of manual labor both for replacing the annular segments in the process of the winding operation and for supporting in the winding area the relatively stiff wire, which is supplied into this area under tension.

There is also known another apparatus, wheel comprises a rotatable base fastened in a cantilever fashion on the vertical column of the machine. Said base is movable axially of the column and is provided with spring-loaded wire-placing members moving circumferentially together with a coil being laid, the base further supporting thereon wire-supporting members, also spring-loaded, which are radially displaced in the process of the winding operation from the outermost turn toward the innermost one.

However, said known machine has a complicated and bulky structure and is not suitable for winding in a horizontal position, and the winding of coils of a considerable size is limited by the outreach of the cantilever mounting.

There is also known yet another machine performing the operation of winding continuous windings without changing the position of the winding sections. This machine comprises a framework having mounted thereon a first stationary stock and a second stock which is horizontally movable along guiding grooves provided in the framework. The first stock is provided with a faceplate, a rotatable center adapted tu support a winding mandrel and a fixing member adapted to rotate the winding mandrel with respect to the center. The second stock is provided with a slide spindle receiving therein the second rotatable center adapted to support the winding mandrel. The framework also supports thereon a horizontally movable carriage actuated by a drive and having an annular housing accommodating therein a rotatable annular base coaxial with the centers. The base supports thereon a plurality of members for placing the wire being wound, the members being movable both axially and radially and being operatively connected via intermediate links with support members. The wire-placing members feed the wire into the section being wound in a pushing fashion, so that in the process of the winding operation the wire being placed is not in a permanently pressed state.

The last-described machine enables continuous windings to be wound without changing the position of the winding sections (here, and throughout the present disclosure, the expression "a section" is meant to describe a combination of the turns of the helically wound wire lying in a single plane). The winding includes several such "sections", and it is necessary, for the sake of maintaining the continuity of the winding, that the odd-numbered sections should be wound from the outermost turn to the innermost one, i.e. from a turn of a greater diameter to a turn of a smaller diameter, and the even-numbered sections should be wound from the innermost turn, with a smaller diameter, to the outer most turn, with a greater diameter. In the process of the manufacture of a winding in this machine, the wire supplied into the section under tension enters this section along a straight line and not along an arc having the radius of the turn being wound. This results in the sections wound from the outermost coil to the innermost one having placed therein less wire than prescribed by the technical specifications concerning windings of specified types.

Besides, on account of the splippage of the wire caused by the absence of permanent pressure against the wire, the diameter of a turn being wound tends to decrease, which hampers the placing of the wire into each successive coil. A disadvantage of this known machine is also the complicated character of the adjustment of the above-described wire-placing and supporting members for a specified size of a winding, said adjustments being effected by means of a complicated system of rods and arms controlling the engagement of pawls pinions. All this significantly complicates the structure of the machine.

The above-mentioned disadvantages adversely affect the quality of continuous windings wound without changing the position of the sections and reduce the productivity of the machine.

It is an object of the present invention to provide a machine for winding continuous electric windings, which should provide for a high quality of winding the wire from the outermost turn of the winding toward the innermost one, without changing the position of the sections, and which should also provide for a higher efficiency, owing to the faster readjustment of the machine to a specified new size of the windings.

It is another object of the present invention to provide such members for controlling the placing of the wire being wound, which should preclude the lessening of the amount of the wire placed into a winding section.

It is a further object of the present invention to provide wire-placing members which should preclude slippage of the wire during the winding process by ensuring uniform pressing of the wire fed into the placing area.

These and other objects are attained in a machine for winding continuous electric windings without changing the position of the sections, comprising a framework having a first stock and a second stock coaxially mounted thereon, the stocks being provided, respectively, with the first and second centers for supporting therebetween a winding mandrel; fixing members fastened to the first center; a slide spindle mounted on the second center to provide for axial movement thereof; and a carriage movable along the axis of the centers and having an annular housing accommodating therein an annular base coaxial with the centers and rotatable by a drive, the base supporting thereon a plurality of wire-placing members movable in two perpendicular directions. In accordance with the present invention, one end of each of the wire-placing members has mounted thereon a rotatable wire guiding member, which is adapted to guide the wire being wound into the section under process, the opposite end of each wire-placing member having mounted thereon a driving roller travelling along a friction templet mounted adjacent to the wire placing area on the annular housing and adapted to transmit rotation to the additional guiding member by means of a friction clutch accommodated within the driving roller.

It is expedient that each feed-in member should be rubber-coated.

The disclosed machine provides for high-quality continuous winding of a wire without changing the position of the winding sections and enables an increase in the overall efficiency of the machine by speeding up the process of readjustment of the wire-placing members to a specified new winding size.

Other objects and advantages of the present invention will be made apparent in the following description of preferred embodiments thereof, with reference to the accompanying drawings, wherein.

Figure 1:
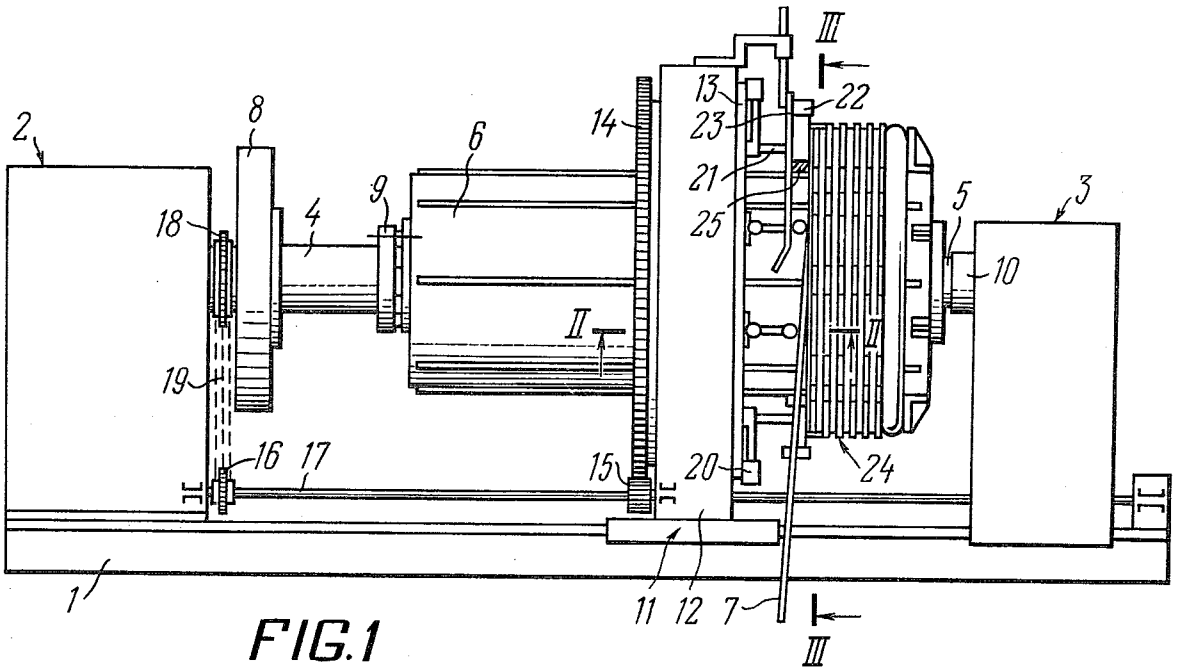
FIG. 1 is a longitudinal general view of a machine for winding continuous electric windings, constructed in accordance with the present invention.

Referring now in particular to the appended drawings, the machine for winding continuous electric windings without changing the position of the sections comprises a framework 1 (FIG. 1) supporting thereon a first stock 2 and a second stock 3, which are coaxial with each other. The first stock 2 is rigidly fixed on the framework 1, while the second stock 3 is mounted on the framework 1 for axial movement. The first stock 2 and the second stock 3 are provided, respectively, with centers 4 and 5 adapted to support therebetween a winding mandrel 6. The winding mandrel 6 is adapted to have the wire 7 being wound placed thereupon.

The first stock 2 is provided with a faceplate 8 and fixing members 9 adapted to rotate the winding mandrel 6 with respect to the center 4.

The second stock 3 is provided with a sliding tail spindle 10 providing axial movement of the center 5.

Furthermore, the framework 1 supports thereon a carriage 11 movable along the axis of the centers 4 and 5. The carriage 11 has an annular housing 12 immovably secured thereon and coaxial with the centers 4 and 5. The annular housing 12 accommodates therein, likewise coaxially with the centers 4 and 5, an annular base 13 rotatable by means of the drive (not shown) of the machine. The driving connection between the rotatable annular base 13 and the drive of the machine in the presently described embodiment is effected by means of a pinion immovably connected with the annular base 13, pinions 15 and 16 secured on a transmission shaft 17, a pinion 18 mounted on the first stock 2 of the machine and a chain drive 19.

The rotatable annular base 13 has immovably secured thereto carriers 20 in which there are movably mounted members 21 for placing the wire 7 being wound.

The wire-placing members 21 are mounted in the carriers 20 for radial movement during the adjustment of the machine to a certain winding size prior to commencing the winding of the wire 7.

One end of each wire-placing member 21 supports a driving roller 22 movable along a friction templet 23, which has an arcuate shape and is secured to the annular housing 12.

The movement of the driving rollers 22 and the engagement with the friction templet 23 upon rotation of the rotatable annular base 13 provides for the corresponding displacement of the wire-placing members 21 toward the section 24 of the wire 7 being wound.

The opposite end of each wire-placing member 21 supports thereon an additional guiding member 25 rotated by the driving roller 22. The additional guiding member 25 in the presently described embodiment is made in the form of a roller adapted to guide the wire 7 into the winding area along an arc and to prevent the slippage of the wire in the process of winding.

To provide for engagement between the additional guiding members 25 and the wire 7 being wound, the former are rubber-coated.

Figure 2:
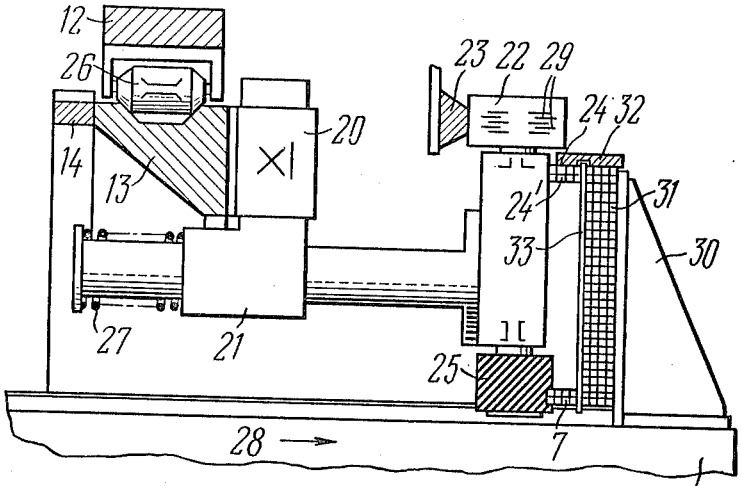
FIG. 2 is a cross sectional view taken along the line II—II of FIG. 1.

FIG. 2 of the appended drawings shows in greater detail the arrangement of the wire-placing members 21 on the annular base 13. The annular base 13 is mounted in the annular housing 12 on bearings 26 which provide for rotation of the annular base 13 about the winding mandrel 6. The friction templet 23 and a spring 27 provide for the movement of the wire-placing members 21 of the wire 7 being wound in the direction indicated by arrow 28.

A friction clutch 29 accommodated within each driving roller 22 transmits rotation from the driving roller 22 to the respective additional guiding member 25.

The mandrel 6 has mounted thereon abutments 30 against which the first wound section 31 is adapted to abut.

To retain the position of the first turn of the section 24 being wound, a ring 32 is applied about the first-wound section 31.

In the drawings, there is illustrated the position of spacers 33 interposed between the first-wound section 31 and the successive section 24 being wound, in accordance with the design of the winding being wound.

Figure 3:
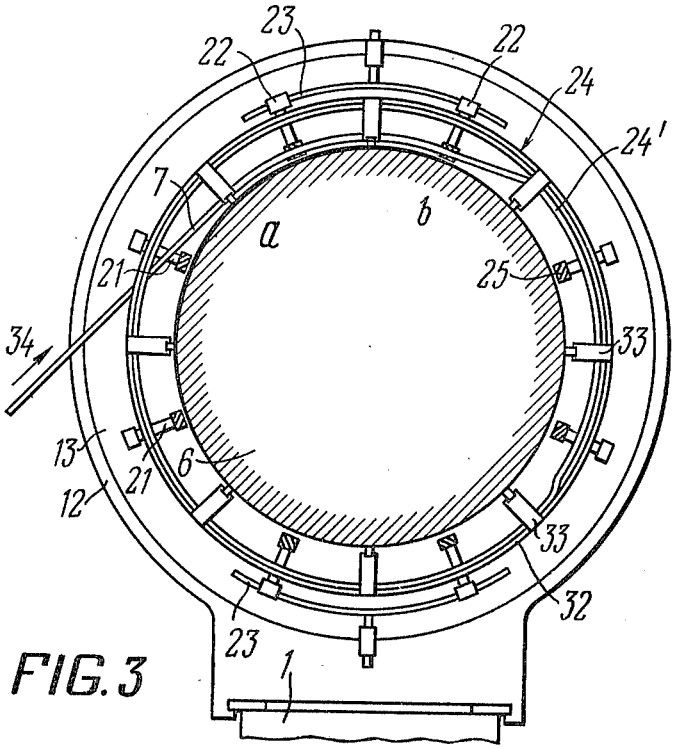
FIG. 3 is a cross sectional view taken along the line III—III of FIG. 1.

FIG. 3 of the appended drawings illustrates the relative positions of the wire 7 being wound and of the additional guiding members 25 in the process of placing of a successive turn in the section 24 being wound. The wire 7 being wound is engaged by the additional guiding members 25 along an arc *a–b* corresponding to the travel of the driving roller 22 in engagement with the friction templet 23.

The rotation of the additional guiding members 25 effects the feeding of the wire 7 being wound in the direction indicated by arrow 34 into the zone of the arc *a–b*, and, therefore, this affects the formation of the turn 24' being wound to an arc of a respective radius, which prevents less wire from being placed into the winding than specified, and also prevents the slippage of the wire between the wire-placing members 21.

The herein disclosed machine for winding continuous electric windings operates, as follows.

A winding mandrel 6 (FIG. 1) is mounted between the centers 4 and 5 and connected to the fixing member 9 by engaging the projections of the fixing member 9 in matching grooves provided in the winding mandrel 6.

Abutments 30 (FIG. 2) are fastened to the mandrel 6. The drive of the machine is energized, and the first section 31 of the winding is wound onto the winding mandrel 6 in a commonly known manner, starting from the innermost turn and continuing toward the outermost turn, the wire-placing members 21 and the additional guiding members 25 taking no part in this stage of the operation.

With the first section 31 of the winding ready, the wire 7 being wound is transferred from the last-wound outermost turn to the position of winding of the successive section 24 which is to be wound from the outermost turn to the innermost one. The spacers 33 are put into place. The carriage 11 (FIG. 1) is displaced toward the section 24 to be wound, for the additional guiding members 25 to be spaced from the already wound first section 31 (FIG. 2) by a distance equalling the thickness of the wire 7 being wound.

The ring 32 is mounted about the external cylindrical surface of the first-wound section 31, to limit the diameter of the outermost turn of the section 24 to be wound.

The drive of the machine is energized, the drive being connected through pinions and gears 14, 15, 16 and 18 (FIG. 1) to the rotatable annular base 13, and the section 24 (FIG. 2) is wound from the outermost turn to the innermost one.

During the winding of the sections from the outermost turn to the innermost one, the driving roller 22 travels along the friction templet 23 and thus directs the wire-placing members 21 toward the section 24 being wound, while the additional guiding member 25, in its turn, displaces the wire 7 being wound in the direction of arrow 28. Upon the engagement of the driving roller 22 (FIG. 3) with the friction templet 23, the additional guiding member 25, operatively connected through the friction clutch 29 (FIG. 2) to the driving roller 22, starts rotating in the direction of an arrow 34 (FIG. 3) and feeds or guides the wire 7 being wound into the section 24 being wound along the arc *a–b*, thus forming a turn of the required diameter. The additional guiding member 25 is coated with rubber of which the friction factor is higher than that of metal, which provides for a better engagement between the additional guiding member 25 and the wire 7 and prevents slippage of the wire. The ring 32 (FIG. 2) serves as a support of the first (outermost) turn being wound, while each of the successive turns abuts against the preceding one.

Upon the driving roller 22 (FIG. 3) having cleared the friction templet 23, the wire-placing member 21 (FIG. 2) abruptly leaves the section 24 being wound, compressing the spring 27 and enabling the wire 7 to be fed toward the mandrel 6.

Upon a section having been wound from the outermost turn to the innermost one, the carriage 11 (FIG. 1) is withdrawin from the section that has been wound, and the wire 7 being wound is tranferred from the last-wound innermost turn to the position where the successive section is to be wound.

While the successive section is being wound from the innermost turn to the outermost one, the wire-placing members 21 and the additional guiding ones 25 take no part in the operation. Then the above-desribed cycle is repeated.

The herein disclosed machine for winding continuous electric windings is structurally simple and provides for high-quality winding of continuous windings without changing the position of the winding sections.

Owing to the wire being fed into the winding area along an arc and also owing to the elimination of slippage of the wire in the wire-placing members, there is precluded any deficiency of the amount of wire placed into the winding, i.e. there is ensured a certain degree of filling of the winding with the wire and, hence, the specified ratings of the winding.

The herein disclosed machine enables simplification of the manufacture of windings and increases the overall efficiency two- and even three-fold, owing to the elimination of the operations of changing the position of the sections, of trimming and of soldering the wire transition points.

Owing to the simplified structure of the wire-placing members, the herein disclosed machine speeds up the adjustment of the machine to a new specified winding size.

Furthermore, the use of the presently disclosed machine effects a saving of insulation materials and solders.

What we claim is:

1. A machine for winding continuous electric windings without changing the position of the winding sections, comprising:

a framework;

a first stock supported by said framework;

a second stock supported by said framework and being coaxial with said first stock;

a first center fastened externally of said first stock;

a second center fastened externally of said second stock;

a winding mandrel supported between said first and second centers;

fixing members mounted on said first center;

a sliding spindle mounted on said second stock for axial movement of the second center;

a carriage movable along the axis of said centers;

an annular housing supported by said carriage;

a rotatable annular base accommodated within said annular housing;

a plurality of wire-placing members fastened to said rotatable annular base and movable in two perpendicular directions, said wire-placing members having a first end and a second end;

an additional guiding member mounted on said first end of each of said wire-placing members to guide said wire into the winding section being wound;

a friction templet mounted on said annular housing;

a driving roller mounted on said second end of each of said wire-placing members and traveling in engagement with said friction templet; and means accommodated within said driving roller to transmit rotation from said driving roller to the respective one of said additional guiding members.

2. A machine as set forth in claim 1, wherein each of said additional guiding members is rubber-coated.

* * * * *